US008544219B1

(12) United States Patent
Janesky

(10) Patent No.: US 8,544,219 B1
(45) Date of Patent: Oct. 1, 2013

(54) AIRTIGHT TRENCH DRAIN SYSTEM

(76) Inventor: Lawrence M. Janesky, Middlebury, CT (US)

( * ) Notice: Subject to any disclaimer, the term of this patent is extended or adjusted under 35 U.S.C. 154(b) by 0 days.

(21) Appl. No.: 13/589,891

(22) Filed: Aug. 20, 2012

(51) Int. Cl.
*E04B 1/70* (2006.01)
*E04F 17/00* (2006.01)

(52) U.S. Cl.
USPC ..... 52/169.5; 52/900; 52/302.3; 4/682

(58) Field of Classification Search
USPC ..... 52/900, 169.5, 302.3; 4/679, 680, 4/682; 454/341
See application file for complete search history.

(56) References Cited

U.S. PATENT DOCUMENTS 4,553,874 A * 11/1985 Thomann et al. ..... 404/4
4,798,034 A * 1/1989 Jarnagin et al. ..... 52/302.3
4,949,626 A 8/1990 Townsend et al.
5,101,712 A 4/1992 Dean, Jr.
5,158,501 A 10/1992 Proskiw
5,277,003 A 1/1994 Myers
5,474,400 A 12/1995 Kliefoth et al.
5,501,044 A 3/1996 Janesky
5,694,723 A 12/1997 Parker
5,771,643 A 6/1998 Parker
5,836,815 A * 11/1998 Jennemann ..... 454/341
6,276,093 B1 8/2001 Janesky
6,524,182 B2 * 2/2003 Kilburn et al. ..... 454/354
7,617,644 B2 * 11/2009 Nielsen ..... 52/302.3
2008/0190045 A1 8/2008 Janesky

* cited by examiner

*Primary Examiner* — Brian Glessner
*Assistant Examiner* — Brian D Mattei
(74) *Attorney, Agent, or Firm* — Perman & Green, LLP

(57) ABSTRACT

A system adapted to remove radon gas and drainage liquid from a subterranean chamber or basement having a floor and an ambient environment. The system has a drainage channel forming a drainage portion and a venting portion. A valve is located between the drainage portion and the venting portion. Drainage liquid flows into the drainage portion and from the drainage portion through the valve into the venting portion. A pressure gradient is between the drainage portion and the venting portion. The valve substantially prevents the ambient environment from entering the venting portion while allowing drainage liquid to flow from the drainage portion into the venting portion.

25 Claims, 6 Drawing Sheets

AIRTIGHT TRENCH DRAIN SYSTEM

BACKGROUND

1. Field

The present embodiment relates to systems and, more particularly, to subterranean chamber drainage and systems.

2. Brief Description of Related Developments

Various types of systems have been devised to drain water from the perimeter of a basement floor. Such drainage systems may involve drainage pipe or drainage channels used in conjunction with a sump or external drain. Additionally, various types of systems have been devised to reduce or mitigate entry of underground vapor (e.g. moist air, underground gas, radon) from basements or subterranean chambers. Such systems range from simple exhaust fans to elaborate schemes to access and remove ground gas that originates from beneath the basement or subterranean chamber to prevent entry into the chamber. A problem arises where the drainage system providing a drain conduit for draining liquid from the chamber, conversely provides an undesired pathway for ground gas into the chamber.

BRIEF DESCRIPTION OF THE DRAWINGS

The foregoing aspects and other features of the present embodiments are explained in the following description, taken in connection with the accompanying drawings, wherein.

DETAILED DESCRIPTION OF THE EXEMPLARY EMBODIMENT

Figure 1:
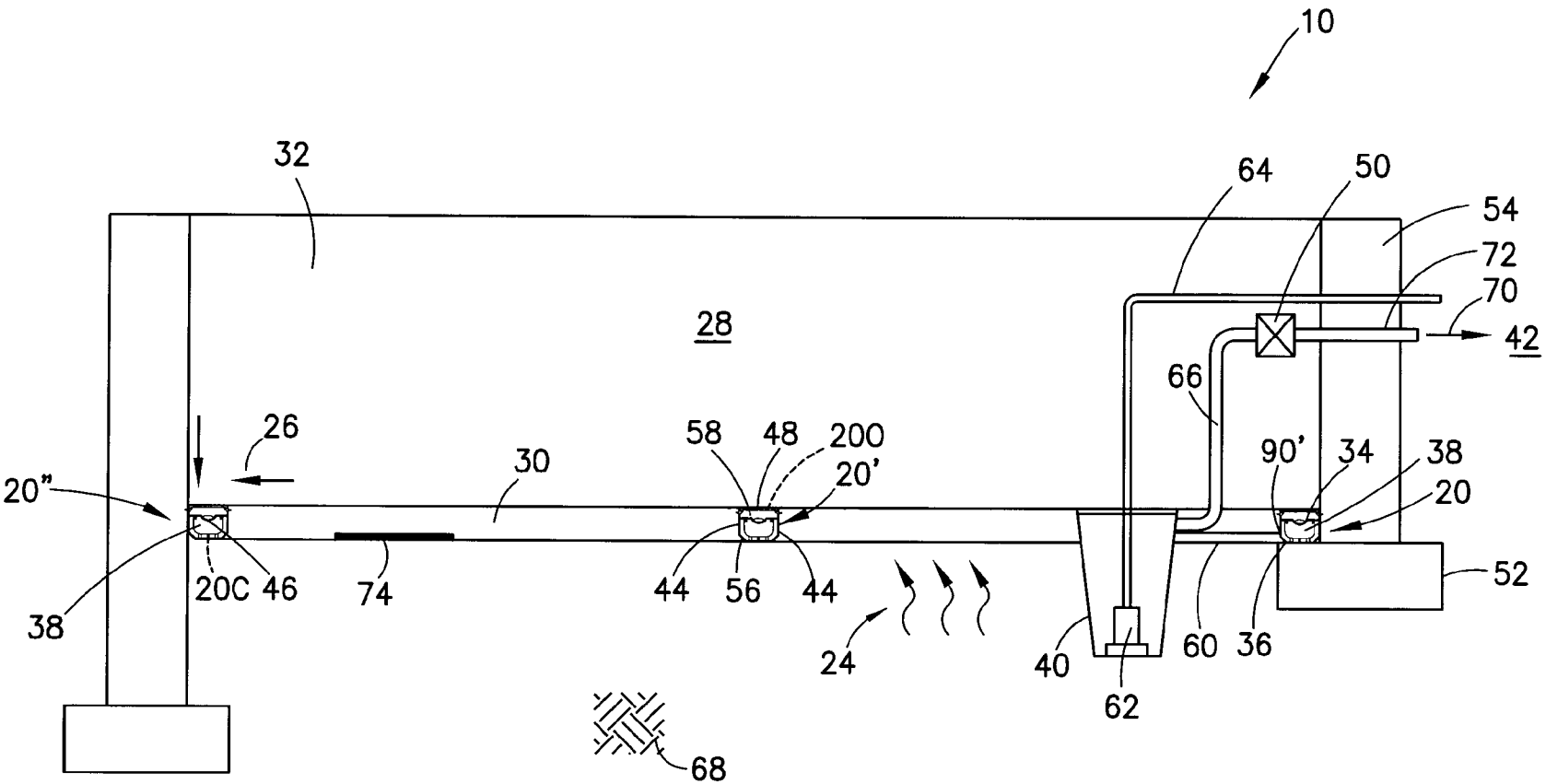
FIG. 1 is a schematic section view illustrating a system with a water receiving conduit installed in a perimeter drainage system.

Although the present embodiments will be described with reference to the embodiments shown in the drawings, it should be understood that the embodiments can be embodied in many alternate forms of embodiments. In addition, any suitable size, shape or type of elements or materials could be used.

Referring now to FIG. 1, there is shown a schematic section view illustrating what may be referred to as a drainage and ground vapor mitigation system 10, or otherwise a drainage system with ground vapor mitigation or an airtight trench drain system. The system 10 has water or other ground liquid receiving channel or trench 20 installed inside a basement or other suitable subterranean chamber, in a perimeter drainage system. Here channel 20 may have multiple sections or portions (20, 20', 20") and may be provided at a perimeter and/or any suitable interior portion of basement 28. The system 10 is provided to prevent or mitigate entry of underground vapors, such as radon gas 24 and effect drainage of liquid 26 from subterranean chamber or basement 28 having floor 30 and an ambient environment 32. In the exemplary embodiment, system 10 may have a drainage channel 20 (20', 20") with drainage conduit 20C (extending along the floor, see also FIG. 2) forming drainage portion 34 and venting portion 36. A removable cover 48 is provided over an opening 20C of the channel 20 through the floor such that cover 48 may be removed to clean debris from channel 20 (20', 20"). Cover 48 may extend over each section of channel 20. Alternately, cover 48 may be provided at only a portion of channel 20. Alternately, cover 48 may not be removable. The channel 20 disengages via a suitable drain 60 to a sump 40. For example venting portion 36 is shown coupled to sump 40 with drain 60. Although one drain 60 is shown, more drains may be provided coupling one or more portions of channel 20 with sump 40. In alternate aspects, sump 40 may not be provided and the drain may discharge fluid to an underground drainage system (e.g. a gravel bed). The drainage and venting 34, 36 portions of the conduit are separated by an interface or isolation wall member 58 that is capable of forming a substantially air tight seal between drainage portion 34 and venting portion 36 and hence substantially isolate or seal the internal atmosphere inside the subterranean chamber from an external atmosphere such as will be described in greater detail below. Valve 38 is located between drainage portion 34 and the venting portion 36. Here, drainage liquid 26 flows into the drainage portion 34 and from the drainage portion 34 through the valve 38 into the venting portion 36. Drainage liquid then flows from venting portion 36 through drain 60 into sump 40. A pump 62 may be provided in sump 40 to eject drainage fluid through ejection pipe 64. A pressure difference or gradient may be formed between the drainage portion 34 and the venting portion 36. Here the pressure gradient may be provided by blower 50 where blower 50 is coupled to sump 40 by pipe 66. The valve 38 substantially prevents the ambient environment 32 from entering the venting portion 36 while allowing drainage liquid 26 to flow from the drainage portion 34 into the venting portion 36. Here, radon gas 24 or other underground gasses and vapors evolving from the base rock, earth or filler 68 are evacuated through perforations in channel 20 and through drain 60, into sump 40, through pipe 66 and blower 50 exhausting 70 through pipe 72 to an external environment 42. Here, the venting portion 36 is shown coupled to a sump 40 with the sump 40 substantially isolated from the ambient environment 32. An exemplary sump may have features as disclosed in U.S. Pat. No. 6,276,093 entitled "Air-Tight Sump Cover With Water Inlet" which is hereby incorporated by reference herein in its entirety. Here, gas 24 is exhausted from the venting portion 36 through the sump 40 and to an environment 42 external to the ambient environment 32. An external portion 44 of the drainage channel may be substantially sealed to the floor 30. In the embodiment shown, the drainage portion 34 is shown located above the venting portion 36 in the drainage channel 20. Further, the drainage portion is shown having a drainage recess 46, the drainage recess 46 directing the drainage fluid 26 into the valve 38. Here and as will be described, the valve may have a trap that collects debris with the drainage fluid 26 preventing clogging of the valve 38. Here, channel 20 is shown having a cover 48 substantially covering the drainage channel 20. In one aspect and as will be described in greater detail, the valve may be a check valve located between the drainage portion 34 and the venting portion 36. In the embodiment shown, blower 50 is coupled to the venting portion 36 where blower 50 exhausts gas from the venting portion 36 and provides a pressure difference between the drainage portion 34 and the venting portion 36 while check valve 38 substantially prevents the ambient environment 32 from entering the venting portion 36 while allowing drainage liquid 26 to flow from the drainage portion 34 into the venting portion 36.

The drainage conduit system 10 is shown installed, for example, under the slab or floor 30 of a subterranean or partially subterranean room or chamber (e.g. a basement or crawlspace). As seen in FIG. 1, the conduit sections 20 of system 10 may be seated on a foundation or footing 52 of the chamber wall 54. Alternately, sections 20 may be otherwise seated. The conduit sections 20 forming the system may be similar, with a lower, channel portion 56 forming a combination venting and drain channel designed to convey water and other drainage liquid along the length of the conduit while receiving water into the interior of the conduit via drainage portion 34 formed by intermediate member 58 having a series of regularly spaced openings 38 having integral valves or check valves. The chamber concrete floor 30 may extend up to the channel portion 56. Each section, cover 48, channel 56 and intermediate portion 58 may be made from polyvinyl chloride (PVC) or other suitable material. In the embodiment shown, a single drainage point 60 is shown. In alternate aspects of the disclosed embodiment, parallel drainage paths 20, 20', 20" with a single or additional parallel drainage points may be provided. In the disclosed embodiment, the internal environment 32 of the basement 28 is isolated from the soil 68 such that gas 24 evolving from the soil 68 is ejected to an external 42 environment. Although concrete floor 30 is shown, in alternate aspects, a vapor barrier 74 may be provided, for example, caulked to the sides 44 of channel(s) 20, 20', 20" such that gas 24 evolving from the soil 68 is isolated from the interior environment 32 of basement 28. The system 10 when installed may have one or more locations along its length at which water is allowed to discharge from channel 20. For example, at a discharge location (not shown), a drain channel section, may be mated to a discharge tube, for example via an opening 90' in the floor and/or wall of the channel 20 below intermediate portion 58 allowing for an egress of water from the conduit. Here, drain tube 60 or tubes may feed into sump 40, from which water may be removed via a mechanical pump. In other embodiments, the drainage system may be configured to allow the water to drain from the conduit and out of the basement by gravity feed to a stream, connection to municipal drain system, or any other suitable pathway. Gravel may be provided on the underside and surrounding sides of the exterior of the conduit 20, below the floor 30 and footing 52 may, for example under poor foundation drainage conditions (e.g. soil saturation) allow ground water to flow into the basement between the footing 52 and basement wall 54, to be collected by the system. Ground water may also enter the channel, for example by flowing down the interior surface of the basement wall 54, or flowing through the wall. In alternate embodiments, basement walls may have pathways therein allowing for the flow of water. For example, gaps between rocks in a rock wall may allow water to flow through the wall from soil on the exterior side of the basement wall such as if mortar is missing or inadequate. Weep holes may be provided in some types of basement wall to allow water to drain from the wall. For example, concrete block may be formed with cavities on the interior of each block. Weep holes may be drilled into a concrete block wall to access these cavities and allow water to drain out of the interior of the wall and through the water receiving channel 20.

Figure 2:
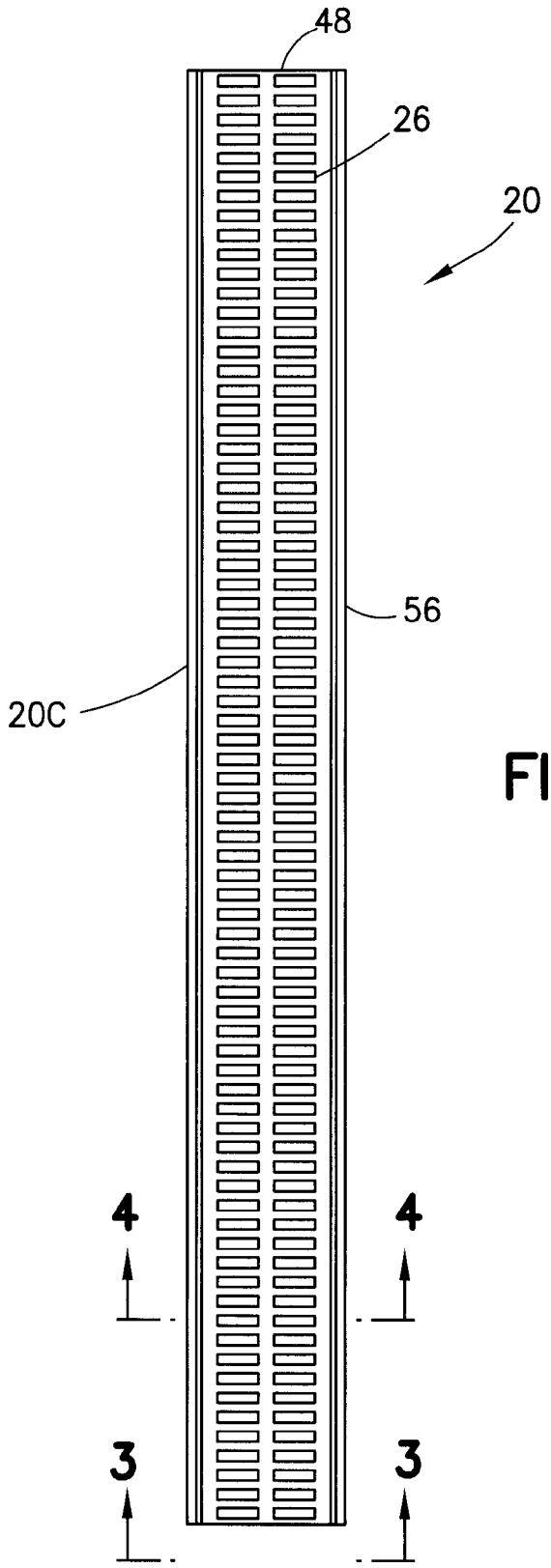
FIG. 2 is a top view of a drainage conduit.
Figure 3:
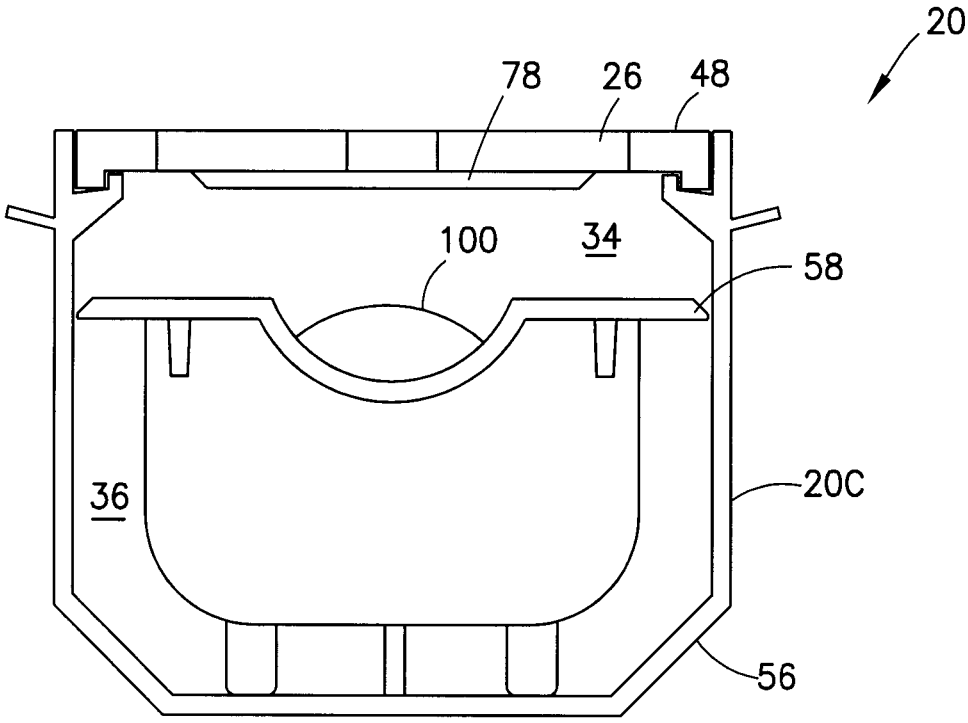
FIG. 3 is a cross-section view of a drainage conduit.
Figure 4:
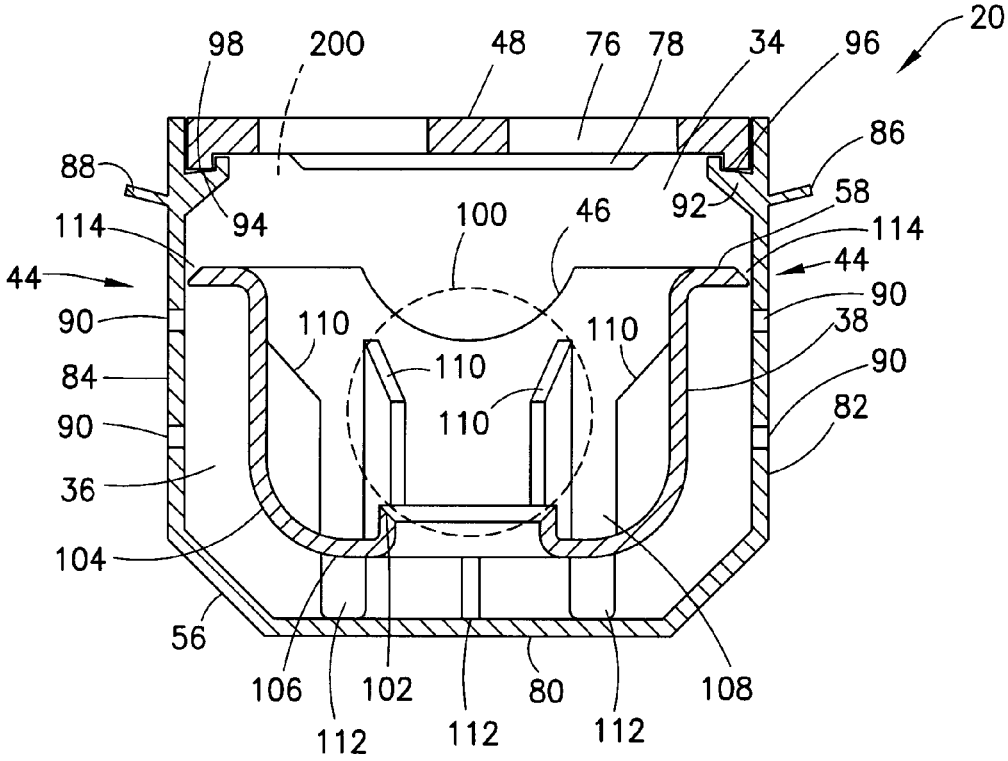
FIG. 4 is a cross-section view of a drainage conduit.
Figure 5:
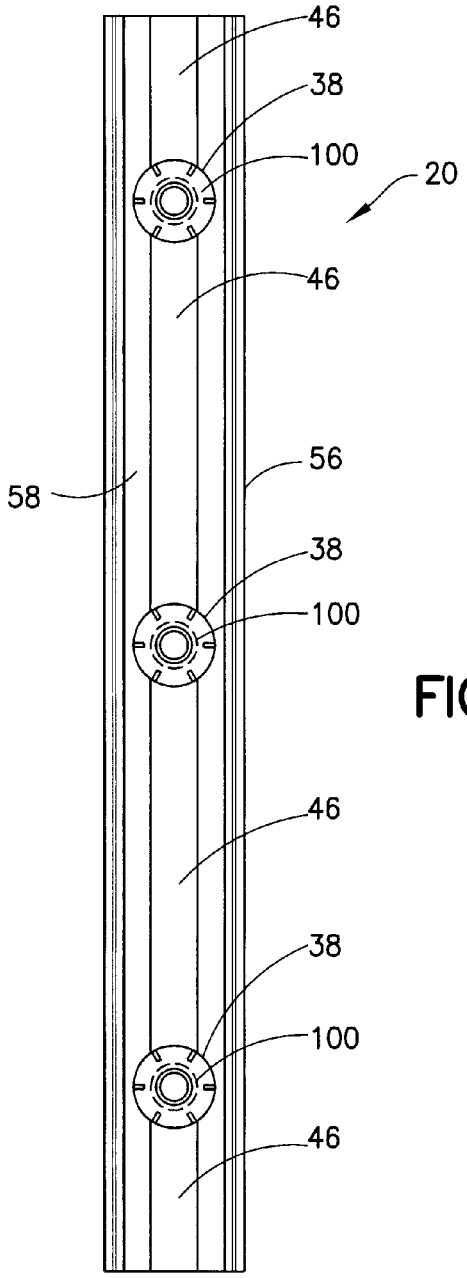
FIG. 5 is a top view of a drainage conduit with a covering portion removed.
Figure 6:
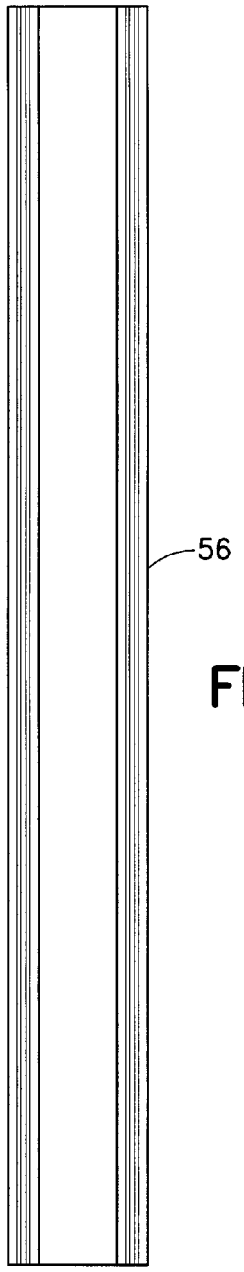
FIG. 6 is a top view of a drainage conduit with a covering portion and an isolation portion removed.
Figure 8:
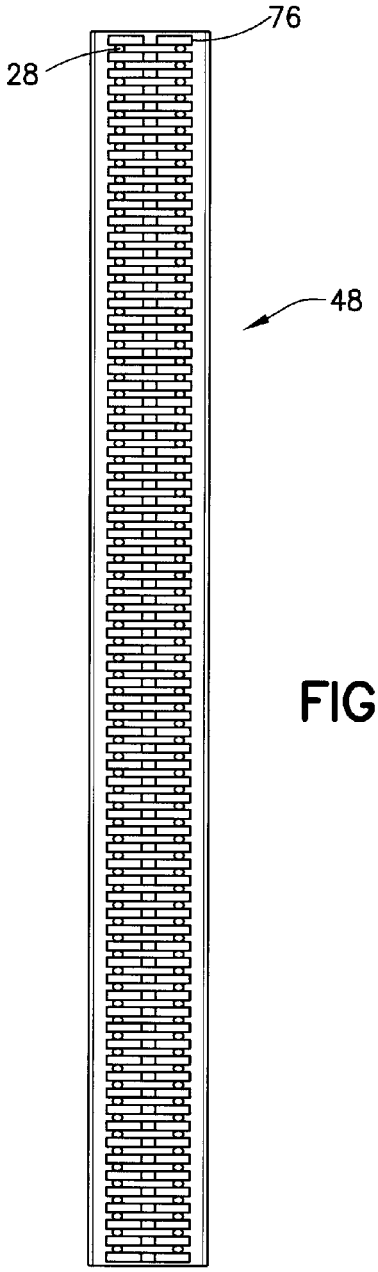
FIG. 8 is a bottom view of a covering portion.

Referring now to FIG. 2, there is shown a top view of drainage conduit 20C. Referring also to FIG. 3, there is shown a cross-section view of drainage conduit 20. Referring also to FIG. 4, there is shown a cross-section view of drainage conduit 20C. Conduit 20C is shown as a single section channel 56 with an opening 200 and cover 48 for example. Multiple channels 20 may be coupled to form a perimeter drain around the perimeter of a basement or otherwise. In accordance with another aspect, only a portion of a basement may be provided with channels 20. For example, the conduit 20 may be installed inside the basement adjacent an exterior entry way (e.g. a basement door or cellar door and doorway) collecting liquid runoff and moisture entering the basement through the entry way. The channels forming the drain may be connected, for example, by abutment and/or by sealing, for example, with caulk or otherwise. Cover 48 is shown having a series of slots 76 that allow drainage liquid to enter drainage portion 34. As can be seen in FIG. 8, there is shown a bottom view of covering portion 48 where ribs 78 are provided between slots 76 of cover 48 for added stiffness and structural support. The channel portion 56 may comprise a base floor 80 and first and second walls 82, 84 each having inner and outer walls or surfaces. First and second protrusions 86, 88 are shown extending from first and second outer walls 82, 84. Here the protrusions may be provided such that the concrete, when poured around them substantially seals against the outer walls 44. Further, protrusions 86, 88 may be flexible, for example, to conform and seal against a wall 54 of basement 28 or other surface. Alternately, a seal may be applied between protrusion 86 and wall 54, for example, by caulk or otherwise. Alternately, no seal may be provided, for example, where the pressure differential provided by blower 50 allows leakage between wall 54 and protrusion 86. Holes, slots or suitable venting 90 may be formed in sides 82, 84 of channel 56 allowing radon gas to enter venting portion 36 and may be located below intermediate portion 58 while allowing drainage fluid to drain at the lower portion of channel 56. A drainage hole may also be provided in channel 56 such that channel 56 may be sealingly mated with a drain pipe 60 connected at the hole, to allow water to egress from the channel. In the embodiment shown, channel 20 may be installed with a slight grade, to direct flowing water from the channel 20 into sump 40. Channel 56 has receiving channels 92, 94 formed on the interior walls 82, 84 respectively that mate with protrusion 96, 98 of cover portion 48 that extend the length of cover portion 48 providing structural support for cover 48. Referring also to FIG. 5, there is shown a top view of drainage conduit 20 with covering portion 48 removed. Referring also to FIG. 6, there is shown a top view of drainage conduit 56. Here, conduit 56 is shown with covering portion 48 and isolation portion or wall member 58 removed. As may be realized from FIGS. 4-5, isolation member 58 is removably seated inside channel 56 and may be installed or removed through channel opening 200. In accordance with one aspect, drain channel 20, may be an existing installation within a basement and the isolation portion 58 may be installed at a subsequent time thereby providing the underground vapor mitigation feature to the drawn system as a retrofit.

Figure 7:
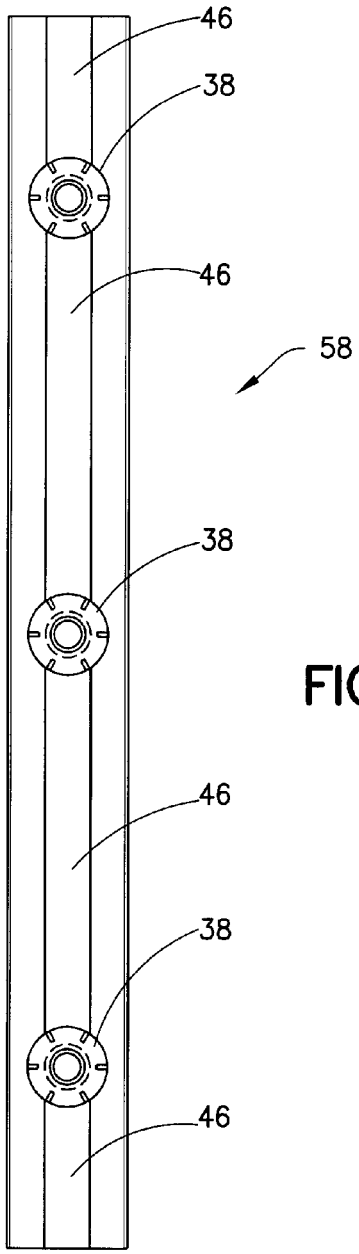
FIG. 7 is a top view of an isolation portion.

Referring also to FIG. 7, there is shown a top view of a portion of isolation wall member 58 that interfaces between drainage portion 34 and venting portion 36 of the chamber 20 (see also FIGS. 1-2). In the embodiment shown, drainage recess 46 extends the length of conduit section 20 directing drainage fluid into three check valves 38. Although three check valves 38 are shown, more or less may be provided in each section. Each valve 38 is shown having a ball 100 seated in a substantially conical seat 102 of intermediate portion 58 or where seat 102 may conform to the mating surface of ball 100. Ball 100 may be hollow and may float, for example, ball 100 may be a ping pong ball or other suitable ball that may float. Here, the combination of ball 100 and seat 102 acts as a check valve with respect to the surrounding ambient environment where a lower pressure in region 36 substantially prevents the ambient environment 32 from crossing the ball 100 and seat 102 interface. Ball 100 is seated in a recess or cup 104 of valve 38 where drainage fluid is directed by channel or drainage recess 46 into cup 104. As drainage fluid level in cup 104 increases, the force urging ball 100 to float unseats ball 100 from seat 102 such that drainage fluid may drain from the drainage region 34 to the venting region 36. The base 106 of cup 104 is offset below seat 102 such that a trap or recess 108 is formed such that debris from drainage fluid may be caught in trap 108 and not contaminate the ball 100 seal 102 interface. Upraised seat 102 relative to base 106 in cup recess 104 facilitates opening of the valve when drain fluid collected in recess 108 lifts ball 100 of the seat. Fluid contact between ball 100 and seat 102 prevents underground gas and vapor entry from the vented region through the open valve. The valve automatically closes when fluid drainage through the open valve, lowers the floating ball 100 onto seat 102 thereby closing the valve maintaining sealing against gas and vapors in the venting region. Guides 110 may be provided in cup 104 such that ball 100 is substantially centered on seat 102 when floating and allowing drainage fluid to pass between drainage region 34 and venting region 36. Supports 112 may be provided to support the base 106 of cup 104 and hence supporting intermediate portion 58. Intermediate wall portion 58 may be seated within channel 56 as shown (see for example FIG. 4) with a suitable fit between wall edges 114 and in one aspect may be caulked to the inner walls of channel 56. In one aspect of the disclosed embodiment, system 10 may be retrofitted to and existing perimeter drainage system, where for example, intermediate portion 58, balls 100 and associated elements to provide exhaust and venting of gas may be provided. In alternate aspects of the disclosed embodiment, and suitable valves, check valves or otherwise may be provided to allow drainage fluid to drain across a pressure differential while preventing an ambient environment from passing from a drainage region to a venting region.

In accordance with an aspect of the disclosed embodiment, a drainage and ground vapor mitigation system adapted for ground vapor isolation of and liquid drainage from a subterranean chamber or basement having a floor and an internal environment, the system comprises a drainage channel, at least in part inside the subterranean chamber or basement, comprising a drainage conduit extending longitudinally along the floor, the drainage conduit having a drainage portion and a venting portion disposed therein and extending longitudinally along the floor in the drainage conduit, the venting portion and drainage portion interfacing each other and being configured so that the interface therebetween is capable of maintaining a pressure difference across the interface between the internal environment and an external environment having a valve located between the drainage portion and the venting portion; and a discharge drain connected to the drainage channel so that liquid drains out of the drainage channel. The drainage liquid from the basement flows into the drainage portion and from the drainage portion through the valve into the venting portion to the discharge drain.

In accordance with another aspect of the disclosed embodiment, the interface maintains the pressure difference between the drainage portion and the venting portion and wherein the valve substantially prevents entry of the ground vapor into the internal environment through the discharge channel.

In accordance with another aspect of the disclosed embodiment, the drainage discharge includes a sump and the venting portion is coupled to the sump with the sump substantially isolated from the internal environment by the interface.

In accordance with another aspect of the disclosed embodiment, the venting portion is coupled to a sump of the discharge drain with the sump substantially isolated from the internal environment and wherein ground vapor is exhausted from the venting portion through the sump and to the external environment.

In accordance with another aspect of the disclosed embodiment, an external portion of the drainage channel is substantially sealed to the floor.

In accordance with another aspect of the disclosed embodiment, the drainage portion is located above the venting portion in the drainage channel.

In accordance with another aspect of the disclosed embodiment, the drainage portion has a drainage recess, the drainage recess directing the drainage liquid into the valve.

In accordance with another aspect of the disclosed embodiment, the valve comprises a trap and wherein the trap collects debris with the drainage d liquid preventing clogging of the valve.

In accordance with another aspect of the disclosed embodiment comprising a cover substantially covering the drainage channel.

In accordance with another aspect of the disclosed embodiment, the drainage conduit has an opening inside the subterranean chamber or basement, and the interface between the drainage and venting portions is removably installed in the conduit through the opening.

In accordance with another aspect of the disclosed embodiment, drainage system with ground vapor mitigation adapted for ground vapor isolation of and liquid drainage from a subterranean chamber or basement having a floor and an internal environment, the system comprises a drainage channel, at least in part inside the subterranean chamber or basement, comprising a drainage conduit extending longitudinally along the floor and an isolation wall mounted inside the drainage conduit, dividing the conduit lengthwise and forming a drainage portion and a venting portion inside the conduit both of which extend longitudinally along the floor and a check valve located in the isolation wall between the drainage portion and the venting portion, wherein drainage liquid from the basement flows into the drainage portion and from the drainage portion through the check valve into the venting portion.

In accordance with another aspect of the disclosed embodiment, the drainage channel is connected to a discharge drain, and liquid in the drainage channel drains through the venting portion to the discharge drain.

In accordance with another aspect of the disclosed embodiment comprising a blower coupled to the venting portion; and wherein the blower exhausts gas from the venting portion and provides a pressure difference between the drainage portion and the venting portion across the isolation wall.

In accordance with another aspect of the disclosed embodiment, the venting portion is coupled to a sump with the sump substantially isolated from the internal environment.

In accordance with another aspect of the disclosed embodiment, the venting portion is coupled to a sump with the sump substantially isolated from the internal environment and wherein gas is exhausted from the venting portion through the sump and to an environment external to the ambient environment.

In accordance with another aspect of the disclosed embodiment, an external portion of the drainage channel is substantially sealed to the floor.

In accordance with another aspect of the disclosed embodiment, the drainage portion is located above the venting portion in the drainage channel.

In accordance with another aspect of the disclosed embodiment, the drainage portion has a drainage recess, the drainage recess directing the drainage fluid into the check valve.

In accordance with another aspect of the disclosed embodiment, the check valve comprises a trap and wherein the trap collects debris with the drainage fluid preventing clogging of the check valve.

In accordance with another aspect of the disclosed embodiment, a cover substantially covers the drainage channel.

In accordance with another aspect of the disclosed embodiment, a drainage channel is adapted for ground vapor isolation of and liquid drainage from a subterranean chamber or basement having a floor and an internal environment, the drainage channel comprises a channel portion and the channel portion forming a drainage portion and a venting portion and a check valve located between the drainage portion and the venting portion, wherein drainage liquid flows into the drainage portion and from the drainage portion through the check valve into the venting portion and wherein the check valve substantially prevents entry of ground vapor into the interval environment through the drainage channel while allowing drainage liquid to flow from the drainage portion into the venting portion.

In accordance with another aspect of the disclosed embodiment, the drainage portion is located above the venting portion in the channel portion.

In accordance with another aspect of the disclosed embodiment, the drainage portion has a drainage recess, the drainage recess directing the drainage fluid into the check valve.

In accordance with another aspect of the disclosed embodiment, the check valve comprises a trap and wherein the trap collects debris with the drainage fluid preventing clogging of the check valve.

In accordance with another aspect of the disclosed embodiment, further comprising a cover substantially covering the channel portion.

It should be seen that the foregoing description is only illustrative. Various alternatives and modifications can be devised by those skilled in the art. Accordingly, the present embodiments are intended to embrace all such alternatives, modifications, and variances which fall within the scope of the appended claims.

What is claimed is:

1. A drainage and ground vapor mitigation system adapted for ground vapor isolation of and liquid drainage from a subterranean chamber or basement having a floor and an internal environment, the system comprising:

a drainage channel, at least in part inside the subterranean chamber or basement, comprising a drainage conduit extending longitudinally along the floor;

the drainage conduit having a drainage portion and a venting portion disposed therein so that a conduit wall is common to both the drainage portion and the venting portion and extending longitudinally along the floor in the drainage conduit, the venting portion and drainage portion interfacing each other and being configured so that the interface therebetween is capable of maintaining a pressure difference across the interface between the internal environment and an external environment;

a valve located between the drainage portion and the venting portion; and a discharge drain connected to the drainage channel so that liquid drains out of the drainage channel;

wherein drainage liquid from the basement flows into the drainage portion and from the drainage portion through the valve into the venting portion to the discharge drain.

2. The system of claim 1 wherein the interface maintains the pressure difference between the drainage portion and the venting portion and wherein the valve substantially prevents entry of the ground vapor into the internal environment through the discharge channel.

3. The system of claim 1 wherein the drainage discharge includes a sump and the venting portion is coupled to the sump with the sump substantially isolated from the internal environment by the interface.

4. The system of claim 1 wherein the venting portion is coupled to a sump of the discharge drain with the sump substantially isolated from the internal environment and wherein ground vapor is exhausted from the venting portion through the sump and to the external environment.

5. The system of claim 1 wherein an external portion of the drainage channel is substantially sealed to the floor.

6. The system of claim 1 wherein the drainage portion is located above the venting portion in the drainage channel.

7. The system of claim 1 wherein the drainage portion has a drainage recess, the drainage recess directing the drainage liquid into the valve.

8. The system of claim 1 wherein the valve comprises a trap and wherein the trap collects debris with the drainage liquid preventing clogging of the valve.

9. The system of claim 1 further comprising a cover substantially covering the drainage channel.

10. The system of claim 1 wherein the drainage conduit has an opening inside the subterranean chamber or basement, and the interface between the drainage and venting portions is removably installed in the conduit through the opening.

11. A drainage system with ground vapor mitigation adapted for ground vapor isolation of and liquid drainage from a subterranean chamber or basement having a floor and an internal environment, the system comprising:

a drainage channel, at least in partly inside the subterranean chamber or basement, comprising a drainage conduit extending longitudinally along the floor;

an isolation wall mounted inside the drainage conduit, dividing the conduit lengthwise and forming a drainage portion and a venting portion inside the conduit, both of which extend longitudinally along the floor, so that a conduit wall is common to both the drainage portion and the venting portion;

a check valve located in the isolation wall between the drainage portion and the venting portion;

wherein drainage liquid from the basement flows into the drainage portion and from the drainage portion through the check valve into the venting portion.

12. The system of claim 11, wherein the drainage channel is connected to a discharge drain, and liquid in the drainage channel drains through the venting portion to the discharge drain.

13. The system of claim 11, further comprising a blower coupled to the venting portion; and wherein the blower exhausts gas from the venting portion and provides a pressure difference between the drainage portion and the venting portion across the isolation wall.

14. The system of claim 11 wherein the venting portion is coupled to a sump with the sump substantially isolated from the internal environment.

15. The system of claim 11 wherein the venting portion is coupled to a sump with the sump substantially isolated from the internal environment and wherein gas is exhausted from the venting portion through the sump and to an environment external to the ambient environment.

16. The system of claim 11 wherein an external portion of the drainage channel is substantially sealed to the floor.

17. The system of claim 11 wherein the drainage portion is located above the venting portion in the drainage channel.

18. The drainage channel system of claim 17 wherein the drainage portion is located above the venting portion in the channel portion.

19. The drainage channel of claim 17 wherein the drainage portion has a drainage recess, the drainage recess directing the drainage fluid into the check valve.

20. The drainage channel of claim 17 wherein the check valve comprises a trap and wherein the trap collects debris with the drainage fluid preventing clogging of the check valve.

21. The drainage channel of claim 17 further comprising a cover substantially covering the channel portion.

22. The system of claim 11 wherein the drainage portion has a drainage recess, the drainage recess directing the drainage fluid into the check valve.

23. The system of claim 11 wherein the check valve comprises a trap and wherein the trap collects debris with the drainage fluid preventing clogging of the check valve.

24. The system of claim 11 further comprising a cover substantially covering the drainage channel.

25. A drainage channel adapted for ground vapor isolation of and liquid drainage from a subterranean chamber or basement having a floor and an internal environment, the drainage channel comprising:

a channel portion;

the channel portion forming a drainage portion and a venting portion therein so that a channel wall is common to both the drainage portion and the venting portion; and a check valve located within the channel portion between the drainage portion and the venting portion;

wherein drainage liquid flows into the drainage portion and from the drainage portion through the check valve into the venting portion and wherein the check valve substantially prevents entry of ground vapor into the internal environment through the drainage channel while allowing drainage liquid to flow from the drainage portion into the venting portion.

* * * * *